US012458111B2

(12) United States Patent
Anderson et al.

(10) Patent No.: US 12,458,111 B2
(45) **Date of Patent: *Nov. 4, 2025**

(54) FOOTWEAR WITH ALTERNATE LACING SYSTEMS

(71) Applicant: Canada Goose Inc., Toronto (CA)

(72) Inventors: Christopher Anderson, Barnstaple (GB); Adam Meek, Etobicoke (CA); Oliver Saunders, Bristol (GB); Michael Edward Blackford, York (CA)

(73) Assignee: Canada Goose Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/388,284

(22) Filed: Nov. 9, 2023

(65) Prior Publication Data

US 2024/0074539 A1 Mar. 7, 2024

Related U.S. Application Data

(63) Continuation of application No. 17/476,727, filed on Sep. 16, 2021, now Pat. No. 11,849,812.

(51) Int. Cl.
*A43C 7/00* (2006.01)
*A43B 23/26* (2006.01)
(Continued)

(52) U.S. Cl.
CPC ..... *A43C 7/00* (2013.01); *A43B 23/26* (2013.01); *A43C 11/008* (2013.01); *A43C 11/12* (2013.01)

(58) Field of Classification Search
CPC .. A43B 23/26; A43B 3/02; A43B 3/04; A43B 5/002; A43B 23/045; A43C 7/00; A43C 11/12; A43C 11/008
See application file for complete search history.

(56) References Cited

U.S. PATENT DOCUMENTS 509,707 A 11/1893 Vachon
954,390 A 4/1910 Harris
(Continued)

FOREIGN PATENT DOCUMENTS

DE 8207706 U1 8/1982
EM 000487665-0002 2/2006
(Continued)

OTHER PUBLICATIONS

U.S. Appl. No. 17/476,727, "Non-Final Office Action", Mar. 20, 2023, 10 pages.
(Continued)

*Primary Examiner* — Katharine G Kane
(74) *Attorney, Agent, or Firm* — Kilpatrick Townsend & Stockton LLP

(57) ABSTRACT

A footwear article includes (a) an upper having a tongue opening at a front thereof; (b) a gusseted tongue including a tongue panel positioned over the tongue opening and a pair of gussets attaching laterally opposite sides of the tongue panel to the upper; (c) a pair of tongue fasteners configured to selectively fasten and unfasten corresponding sides of the tongue panel to and from the upper; (d) a first lacing system on the upper and arranged for guiding lacing over the gusseted tongue and tongue fasteners when the sides of the tongue are fastened to the upper; and (e) a second lacing system on the tongue panel and arranged for guiding the lacing across the tongue panel clear of the tongue fasteners when the sides of the tongue panel are unfastened from the upper.

8 Claims, 5 Drawing Sheets

(51) Int. Cl.
*A43C 11/00* (2006.01)
*A43C 11/12* (2006.01)

(56) References Cited

U.S. PATENT DOCUMENTS

| | | | |
|---|---|---|---|
| 1,603,144 | A | 10/1926 | Nichols |
| 1,608,214 | A | 11/1926 | Janke |
| 1,670,468 | A | 5/1928 | Martin et al. |
| 1,684,660 | A | 9/1928 | Blair |
| 1,798,470 | A | 3/1931 | Janke |
| 1,798,471 | A | 3/1931 | Janke |
| 2,190,579 | A | 2/1940 | May |
| 2,222,832 | A | 11/1940 | Clark |
| 2,357,980 | A | 9/1944 | Sam |
| 3,169,325 | A | 2/1965 | Fesl |
| 3,509,646 | A | 5/1970 | Metas |
| 3,783,534 | A | 1/1974 | Phillips et al. |
| D236,665 | S | 9/1975 | Massacre |
| 4,217,706 | A | 8/1980 | Vartanian |
| 4,391,049 | A | 7/1983 | Parisotto |
| 5,940,990 | A | 8/1999 | Barret |
| 5,966,841 | A | 10/1999 | Barret |
| 6,119,372 | A | 9/2000 | Okajima |
| 6,305,103 | B1 | 10/2001 | Camargo |
| D485,051 | S | 1/2004 | Bradford |
| 9,949,532 | B2 | 4/2018 | Xanthos et al. |
| 2003/0034365 | A1 | 2/2003 | Azam et al. |
| 2006/0005429 | A1 | 1/2006 | Min |
| 2006/0185193 | A1 | 8/2006 | Pellegrini |
| 2006/0277787 | A1 | 12/2006 | Vattes et al. |
| 2007/0107257 | A1 | 5/2007 | Laska |
| 2009/0126227 | A1 | 5/2009 | Rivas et al. |
| 2011/0296712 | A1 | 12/2011 | Settele et al. |
| 2013/0180132 | A1 | 7/2013 | Settele |
| 2013/0283639 | A1 | 10/2013 | Williams et al. |
| 2014/0157625 | A1 | 6/2014 | Smaldone et al. |
| 2014/0208550 | A1 | 7/2014 | Neiley |
| 2015/0313309 | A1 | 11/2015 | Darden et al. |
| 2016/0106183 | A1 | 4/2016 | Roberson |
| 2016/0374432 | A1 | 12/2016 | Park |
| 2017/0065028 | A1 | 3/2017 | Foster et al. |
| 2019/0343232 | A1 | 11/2019 | Auyang |
| 2019/0350305 | A1 | 11/2019 | Kerr et al. |
| 2020/0260817 | A1 | 8/2020 | Kapoor |
| 2021/0022447 | A1 | 1/2021 | Cobb |

FOREIGN PATENT DOCUMENTS

| | | | |
|---|---|---|---|
| EM | 001707464-0014 | | 5/2010 |
| EM | 001976929-0017 | | 1/2012 |
| EM | 001428544-0051 | | 1/2015 |
| EM | 001471965-0161 | | 5/2019 |
| EM | 008270375-0001 | | 11/2020 |
| EP | 0569012 | B1 | 1/1996 |
| EP | 1256286 | A2 | 11/2002 |
| EP | 1537799 | A1 | 6/2005 |
| JP | D1117755 | S | 8/2001 |
| JP | D1132845 | | 2/2002 |
| JP | D1139982 | | 4/2002 |
| JP | D1139987 | S | 4/2002 |
| JP | 1173748 | S | 5/2003 |
| JP | D1228071 | | 1/2005 |
| JP | D1373097 | | 11/2009 |
| JP | D1466493 | S | 10/2015 |
| JP | D1454143 | | 10/2019 |
| JP | D1258643 | | 12/2019 |
| JP | D1659761 | S | 5/2020 |
| KR | 300781820 | | 1/2015 |
| KR | 301001648 | | 4/2019 |
| KR | 301001649 | | 4/2019 |
| KR | 301004834 | | 5/2019 |
| WO | 0164066 | A2 | 9/2001 |
| WO | 2017175141 | A1 | 10/2017 |
| WO | 2021081572 | A1 | 5/2021 |

OTHER PUBLICATIONS

U.S. Appl. No. 17/476,727, "Notice of Allowance", Sep. 13, 2023, 7 pages.

EP22185727.9, "Extended European Search Report", Dec. 20, 2022, 10 pages.

JP Patent Office Design Division Publication Material No. HA14000084, Catalog Page. Mountains and Valleys, Issue No. 798, p. 133, Jan. 1, 2002, 2 pages.

JP Patent Office Design Publication Material No. HA14003454, Catalog Page. Mountains and Valleys, Issue No. 800, p. 12, Mar. 1, 2002, 2 pages.

JP Patent Office Design Division Publication Material No. HA14025624, Catalog Page. Issue No. 81, p. 149, Jan. 1, 2003, 2 pages.

JP Patent Office Design Division Publication Material No. HA16032001, Catalog Page. Issue No. 835, p. 168, Jan. 1, 2005, 2 pages.

JP Patent Office Design Division Publication Material No. HA18000915, Catalog Page. Issue No. 851, p. 57, Apr. 1, 2006, 2 pages.

JP Patent Office Design Division Publication Material No. HA19002998, Catalog Page. Issue No. 863, p. 43, Apr. 1, 2007, 2 pages.

JP Patent Office Design Division Publication Material No. HA29001133, Catalog Page. vol. 980, p. 113, Dec. 1, 2016, 2 pages.

JP Patent Office Design Division Publication Material No. HB02010303, Catalog Page. Footwear News, Issue 49, p. 42, Dec. 4, 1989, 2 pages.

JP Patent Office Design Division Publication Material No. HC18014322, Catalog Page. Garmont, Caravan Outdoor Catalog, p. 67, 2006, 2 pages.

JP Patent Office Design Division Publication Material No. HD14008987, Catalog Page. Sport Schuster, p. 154, Dec. 28, 2001, 2 pages.

JP Patent Office Design Division Publication Material No. HJ24052931, Website Page. Goldwin Co., Ltd. Product No. NF51280. The North Face Nuptse Booties, Dec. 3, 2012, 6 pages.

JP Patent Office Design Division Publication Material No. HJ30050950, Website Page. Goldwin Co., Ltd., Product No. NFJ51881. The North Face Nuptse Booties, Sep. 26, 2018, 9 pages.

Japanese Application No. JP2022-021193, "Office Action", Mar. 3, 2023, 8 pages (4 pages of Original Document and 4 Pages of English Translation).

JP Patent Office Design Division Publication Material No. JPHB13016404, Catalog Page. The National Institute of Industrial Property, an independent administrative agency, ARS sutoria, Design of shoe soles on p. 164, Jun. 13, 2011, 2 pages.

FOOTWEAR WITH ALTERNATE LACING SYSTEMS

CROSS-REFERENCE TO RELATED APPLICATION

This application is a continuation application of U.S. application Ser. No. 17/476,727, filed Sep. 16, 2021, entitled FOOTWEAR WITH ALTERNATE LACING SYSTEMS ("the '727 application"). The '727 application is hereby incorporated herein in its entirety by this reference.

FIELD

The specification relates generally to footwear, and more specifically, to footwear fastening systems.

BACKGROUND

Footwear articles (e.g. boots) often include fastening systems (e.g. lacing systems, zippers, hook-and-loop fasteners, etc.) for tightening and securing the footwear around a foot and/or lower leg of a wearer.

SUMMARY

The following summary is intended to introduce the reader to various aspects of the applicant's teaching, but not to define any invention.

According to some aspects, a boot for being worn on a foot and a lower leg of a wearer includes: (a) an upper having a forefoot portion for covering a forefoot of the wearer, a rear portion opposite the forefoot portion for covering a rear of the foot and the lower leg of the wearer, and a pair of laterally spaced apart side portions extending between the forefoot and rear portions for covering opposite sides of the foot and the lower leg. The pair of side portions have corresponding front edges above the forefoot portion and spaced laterally apart from each other by a tongue opening. The boot further includes (b) a gusseted tongue covering the tongue opening. The gusseted tongue includes a tongue panel positioned over the tongue opening and a pair of gussets attaching opposite side edges of the tongue panel to corresponding side portions of the upper. The boot further includes (c) a pair of tongue fasteners configured to selectively fasten and unfasten corresponding side edges of the tongue panel to corresponding side portions of the upper. The tongue fasteners are configurable between an open configuration, in which each side edge of the tongue panel is spaced apart from the front edge of a corresponding side portion by a gap across which a corresponding gusset extends to expand a boot opening of the boot, and a closed configuration, in which each side edge of the tongue panel is fastened to, and adjacent the front edge of, a corresponding side portion to close the gap and collapse the gusset for contracting the boot opening. The boot further includes (d) an outboard lacing system on the side portions of the upper outboard of the tongue fasteners. The outboard lacing system includes a pair of outboard rows of lace guides. Each outboard row is adjacent the front edge of a corresponding side portion, and the pair of outboard rows are arranged for guiding lacing therebetween across the gusseted tongue and tongue fasteners when the tongue fasteners are in the closed configuration. The boot further includes (e) an inboard lacing system on the tongue panel inboard of the tongue fasteners. The inboard lacing system includes a pair of inboard rows of lace guides. Each inboard row is attached to the tongue panel adjacent a corresponding side edge, and the pair of inboard rows are arranged for guiding lacing therebetween across the tongue panel clear of the tongue fasteners and gussets when the tongue fasteners are in the open configuration.

In some examples, each tongue fastener comprises a zipper.

In some examples, the boot further includes a lower lacing system on at least the forefoot portion of the upper below the tongue fasteners. The lower lacing system includes a pair of lower rows of lace guides. Each lower row is positioned toward a corresponding side of the upper, and the pair of lower rows are arranged for guiding a lower portion of the lacing across at least the forefoot portion while an upper portion of the lacing is guided through either one of the inboard lacing system and the outboard lacing system.

In some examples, each inboard row of lace guides comprises a plurality of lace-receiving openings spaced apart from each other along a corresponding side edge of the tongue panel. In some examples, the inboard lacing system comprises a pair of strips attached to the tongue panel. Each strip extends along and adjacent a corresponding side edge of the tongue panel and has: (i) a plurality of attached portions attached to the tongue panel and spaced apart from each other along the side edge, and (ii) a plurality of detached portions interspersed between the attached portions and spaced apart from the tongue panel to define the lace-receiving openings.

In some examples, the rear and side portions of the upper have lower sections defining quarters of the boot, and upper sections defining a rear and sides of a shaft section of the boot. The shaft section extends upwards from the quarters to an upper periphery of the upper circumscribing the boot opening. The tongue panel, gussets, tongue fasteners, and gaps extend along generally an entire length of the shaft section.

According to some aspects, a footwear article includes (a) an upper having a tongue opening at a front thereof and a foot-receiving opening at a top thereof; (b) a gusseted tongue including a tongue panel positioned over the tongue opening and a pair of gussets attaching laterally opposite sides of the tongue panel to the upper; (c) a pair of tongue fasteners configured to selectively fasten and unfasten the corresponding sides of the tongue panel to and from the upper for collapsing and expanding the gussets to contract and expand, respectively, the foot-receiving opening; (d) a first lacing system on the upper and arranged for guiding lacing over the gusseted tongue and tongue fasteners when the sides of the tongue are fastened to the upper; and (e) a second lacing system on the tongue panel and arranged for guiding the lacing across the tongue panel clear of the tongue fasteners when the sides of the tongue panel are unfastened from the upper.

In some examples, each tongue fastener comprises a zipper.

In some examples, the first lacing system includes a pair of first rows of lace guides attached to the upper on opposite sides of the gusseted tongue.

In some examples, the second lacing system includes a pair of second rows of lace guides attached to the tongue panel. Each second row is adjacent and extends along a corresponding side of the tongue panel.

In some examples, the footwear article further includes a third lacing system on the upper below the first and second lacing systems. The third lacing system is arranged for guiding a lower portion of the lacing across the upper clear of the gusseted tongue and fasteners while an upper portion of the lacing is guided through either one of the first lacing system and the second lacing system. In some examples, the third lacing system includes a pair of third rows of lace guides attached to the upper. Each third row is positioned toward and extends along a corresponding side of the upper.

According to some aspects, a footwear article includes: (a) an upper; (b) at least one gusset in the upper; (c) at least one fastener configured to selectively expand and collapse the gusset for expanding and contracting, respectively, a foot-receiving opening of the footwear article; (d) a first lacing system on the upper and arranged for guiding lacing across the upper over the at least one gusset and the at least one fastener when the at least one gusset is collapsed; and (e) a second lacing system inboard of the first lacing system and arranged for guiding the lacing clear of the at least one gusset and the at least one fastener when the at least one gusset is expanded.

In some examples, the at least one fastener comprises a zipper.

In some examples, the first lacing system comprises a pair of first rows of lace guides, and the second lacing system comprises a pair of second rows of lace guides positioned between the pair of first rows.

In some examples, the footwear article includes a tongue panel having at least one side edge attached to the upper through the at least one gusset, and wherein the first lacing system is outboard of the tongue panel and the at least one gusset, and the second lacing system is on the tongue panel.

In some examples, the footwear article further includes a third lacing system on the upper below the first and second lacing systems. The third lacing system is arranged for guiding a lower portion of the lacing across the upper clear of the at least one gusset and the at least one fastener while an upper portion of the lacing is guided through either one of the first lacing system and the second lacing system.

BRIEF DESCRIPTION OF THE DRAWINGS

The drawings included herewith are for illustrating various examples of articles, systems, and methods of the present specification and are not intended to limit the scope of what is taught in any way. In the drawings.

DETAILED DESCRIPTION

Figure 1:
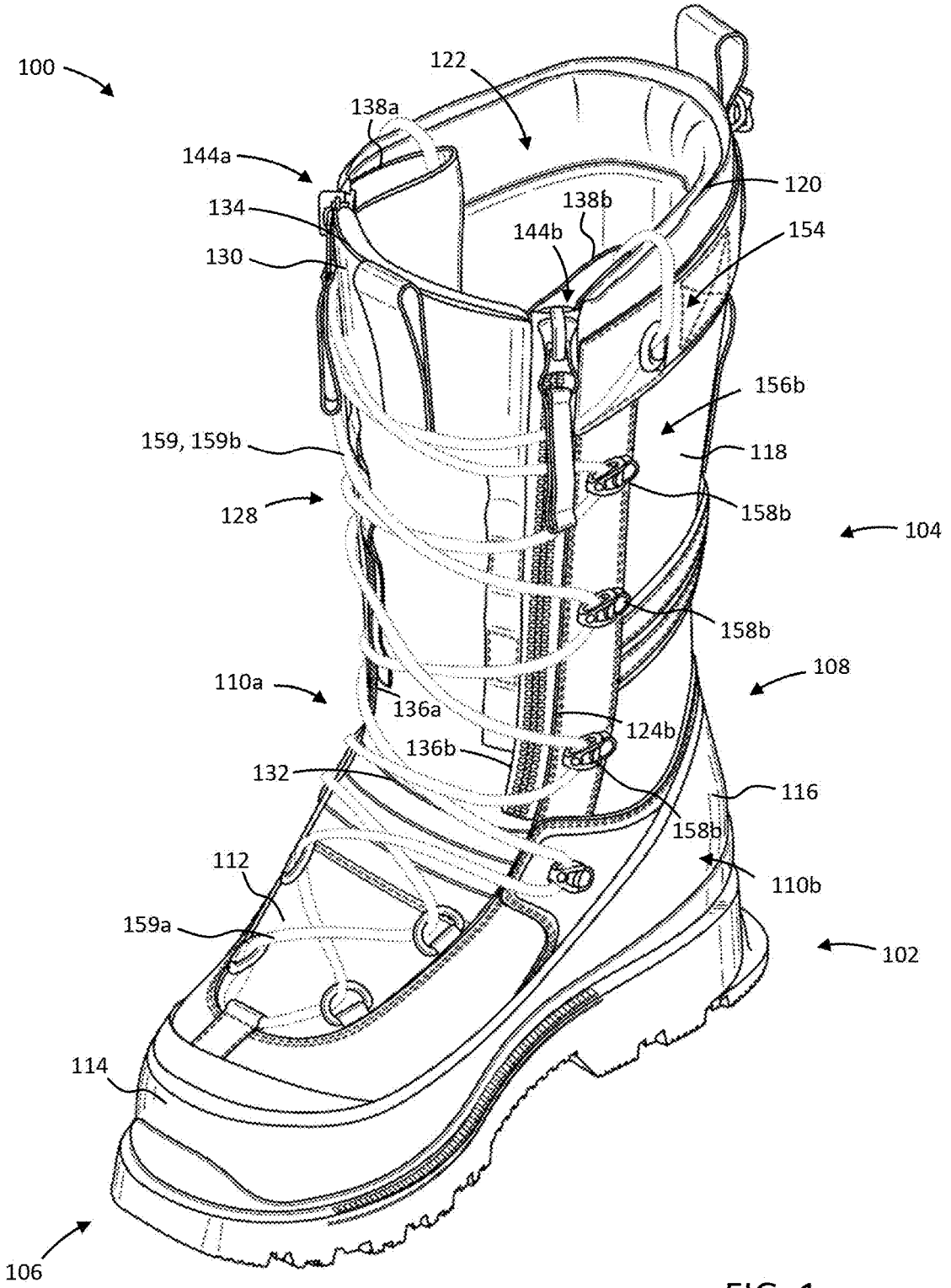
FIG. 1 is a perspective view of an example boot in a contracted configuration.

Various articles, systems, or processes will be described below to provide an example of an embodiment of each claimed invention. No embodiment described below limits any claimed invention and any claimed invention may cover articles, systems, or processes that differ from those described below. The claimed inventions are not limited to articles, systems, or processes having all of the features of any one article, system, or process described below or to features common to multiple or all of the articles, systems or processes described below. It is possible that an article, system or process described below is not an embodiment of any claimed invention. Any invention disclosed in an article, system, or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Footwear articles, such as, for example, boots, often include fastening systems used to contract and tighten the boot around a foot and lower leg of a wearer for a secure fit. It some situations, it may be necessary or desirable to leave the boot partially or completely unfastened and/or expanded during use (e.g. to accommodate insertion of thicker outerwear (e.g. snow pants) into the boot).

According to some aspects of the present disclosure, a footwear article in the form of a boot includes an upper with one or more fasteners (e.g. zippers). The one or more fasteners can be selectively opened to expand a shaft section defining a foot-receiving boot opening of the boot for a looser fit (e.g. by permitting expansion of one or more gussets in the shaft section). The one or more fasteners can be closed to contract the shaft section and boot opening for a tighter fit (e.g. by collapsing the one or more gussets). The boot can further include alternate lacing systems, including a first lacing system for use when the fasteners are closed, and a separate second lacing system for use when the fasteners are open. The first lacing system can be used to adjust tightness of the boot opening and shaft section when contracted and guide lacing over the closed fasteners to, for example, inhibit undesired opening of the fasteners and facilitate a tighter and more secure fit. The second lacing system can be used to adjust tightness of the shaft section when the boot opening and shaft section are expanded, and/or keep lacing clear of the fasteners (e.g. to permit access to and use of the fasteners) and/or arranged in an organized and aesthetically pleasing manner. In some examples, the first lacing system can be provided outboard of the one or more fasteners to allow for the lacing to be guided over the fasteners by the first lacing system, and can be referred to as an outboard lacing system. The second lacing system can be provided inboard of the first lacing system (and in some examples, between a pair of the fasteners), and can be referred to as an inboard lacing system.

Referring to FIG. 1, an example footwear article in the form of a boot 100 is illustrated. The boot 100 has a sole 102 and an upper 104 joined to the sole 102. The upper 104 includes a forefoot portion 106 for covering a forefoot of a wearer, a rear portion 108 opposite the forefoot portion 106 for covering a rear of a foot and lower leg (including the ankle and Achilles Tendon) of the wearer, and a pair of laterally spaced apart side portions 110*a*, 110*b* extending between the forefoot and rear portions 106, 108 for covering opposite (i.e. lateral and medial) sides of the foot and lower leg of the wearer. In the example illustrated, the forefoot portion 106 defines a vamp section 112 and toe cap section 114 of the upper 104. The rear and side portions 108, 110*a*, 110*b* have lower sections that together define quarters 116 of the boot 100, and upper sections that define a rear and sides of a shaft section 118 of the boot 100. The shaft section 118 extends upwardly from the quarters 116 to an upper periphery 120 of the upper 104. In the example illustrated, the upper periphery 120 defines a collar of the boot 100. The upper periphery 120 circumscribes the rear and sides of a foot-receiving boot opening 122 of the boot 100. The boot opening 122 is open to a top of the boot 100.

Figure 2:
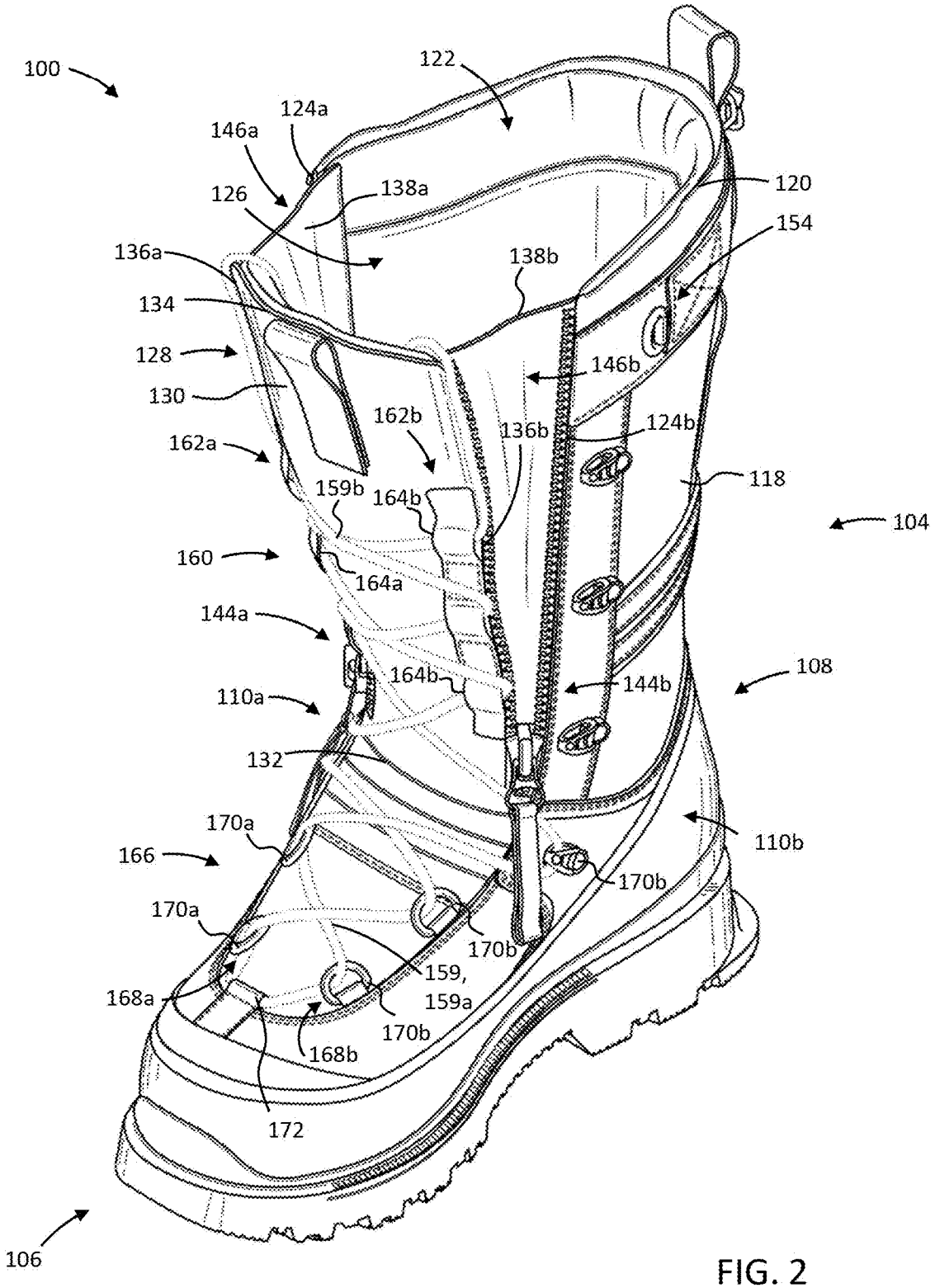
FIG. 2 is a perspective view like that of FIG. 1, but showing the boot in an expanded configuration.

Referring to FIG. 2, in the example illustrated, the pair of side portions 110*a*, 110*b* have corresponding front edges 124*a*, 124*b* above the forefoot portion 106. The front edges 124*a*, 124*b* are spaced laterally apart from each other by a tongue opening 126 open to a front of the upper 104. In the example illustrated, the front edges 124*a*, 124*b* and tongue opening 126 are on the shaft section 118 of the boot 100, and extend along generally an entire length of the shaft section 118.

In the example illustrated, the boot 100 includes a gusseted tongue 128 covering the tongue opening 126. In the example illustrated, the tongue 128 defines a front of the shaft section 118. In the example illustrated, the gusseted tongue 128 includes a tongue panel 130 positioned over the tongue opening 126. In the example illustrated, the tongue panel 130 has a lower end 132 attached to the forefoot portion 106 of the upper 104, an upper end 134 adjacent the upper periphery 120 and circumscribing a front of the boot opening 122, and a pair of side edges 136*a*, 136*b* extending on laterally opposite sides of the tongue panel 130 between the lower end 132 and upper end 134.

Still referring to FIG. 2, in the example illustrated, the gusseted tongue 128 has a pair of gussets 138*a*, 138*b* attaching corresponding side edges 136*a*, 136*b* of the tongue panel 130 to corresponding side portions 110*a*, 110*b* of the upper 104. In the example illustrated, each gusset 138*a*, 138*b* comprises a sheet of material, and extends lengthwise (vertically in the example illustrated) along a corresponding side edge 136*a*, 136*b* of the tongue panel 130 between the lower end 132 and the upper end 134. In the example illustrated, each gusset 138*a*, 138*b* extends laterally between an inner edge attached to the tongue panel 130 adjacent a corresponding side edge 136*a*, 136*b* of the tongue panel 130, and an outer edge attached to a corresponding side portion 110*a*, 110*b* adjacent the front edge 124*a*, 124*b*.

Referring to FIG. 1, in the example illustrated, the boot 100 includes a pair of tongue fasteners 144*a*, 144*b* configured to selectively fasten and unfasten corresponding side edges 136*a*, 136*b* of the tongue panel 130 to corresponding side portions 110*a*, 110*b* of the upper 104. In the example illustrated, the tongue fasteners 144*a*, 144*b* are configurable between an open configuration (shown in FIG. 2) and a closed configuration (shown in FIG. 1). Referring to FIG. 2, when the tongue fasteners 144*a*, 144*b* are in the open configuration, each side edge 136*a*, 136*b* of the tongue panel 130 is spaced laterally apart from the front edge 124*a*, 124*b* of a corresponding side portion 110*a*, 110*b* by a gap 146*a*, 146*b* across which a corresponding gusset 138*a*, 138*b* extends to expand the boot opening 122 and shaft section 118. This can help provide for a looser fit around the lower leg to, for example, accommodate thicker legwear (e.g. snow pants). Referring to FIG. 1, when the tongue fasteners 144*a*, 144*b* are in the closed configuration, each side edge 136*a*, 136*b* of the tongue panel 130 is fastened to, and adjacent the front edge 124*a*, 124*b* of, a corresponding side portion 110*a*, 110*b* to close the gap 146*a*, 146*b* and collapse a corresponding gusset 138*a*, 138*b* for contracting the boot opening 122 and shaft section 118. This can allow for a tighter, and in some examples more secure, fit around the lower leg.

Figure 3:
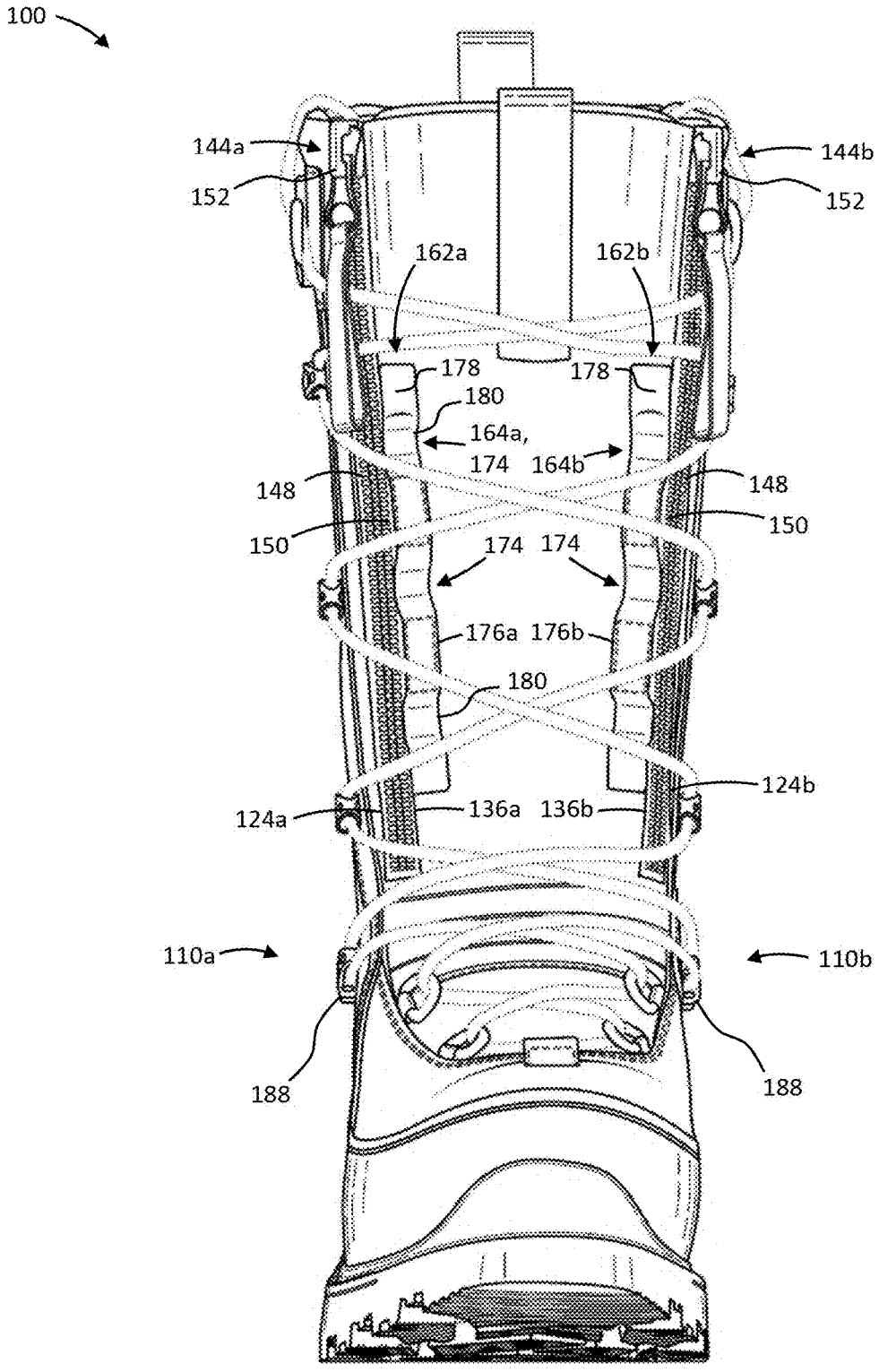
FIG. 3 is a front view of the boot of FIG. 1.

Referring to FIG. 3, in the example illustrated, each tongue fastener 144*a*, 144*b* comprises a zipper. Each zipper includes an outer row 148 of interlockable teeth extending along the front edge 124*a*, 124*b* of a corresponding side portion 110*a*, 110*b*, an inner row 150 of interlockable teeth extending along a corresponding side edge 136*a*, 136*b* of the tongue panel 130, and a slider 152 movable upwards and downwards along the outer and inner rows 148, 150 of teeth to zip and unzip the zipper.

Referring to FIG. 2, in the example illustrated, each tongue fastener 144*a*, 144*b* extends along a corresponding side edge 136*a*, 136*b* of the tongue panel 130 from the lower end 132 to the upper end 134 of the tongue panel 130. In the example illustrated, when the fasteners 144*a*, 144*b* are in the open configuration, each gap 146*a*, 146*b* extends along a corresponding side edge 136*a*, 136*b* of the tongue panel 130 from the lower end 132 to the upper end 134 of the tongue panel 130, and each gap 146*a*, 146*b* is generally V-shaped and expands laterally in an upward direction toward the upper end 134 of the tongue panel 130. In the example illustrated, the tongue panel 130, gussets 138*a*, 138*b*, tongue fasteners 144*a*, 144*b*, and gaps 146*a*, 146*b* extend along generally the entire length of the shaft section 118 of the boot 100.

Figure 5:
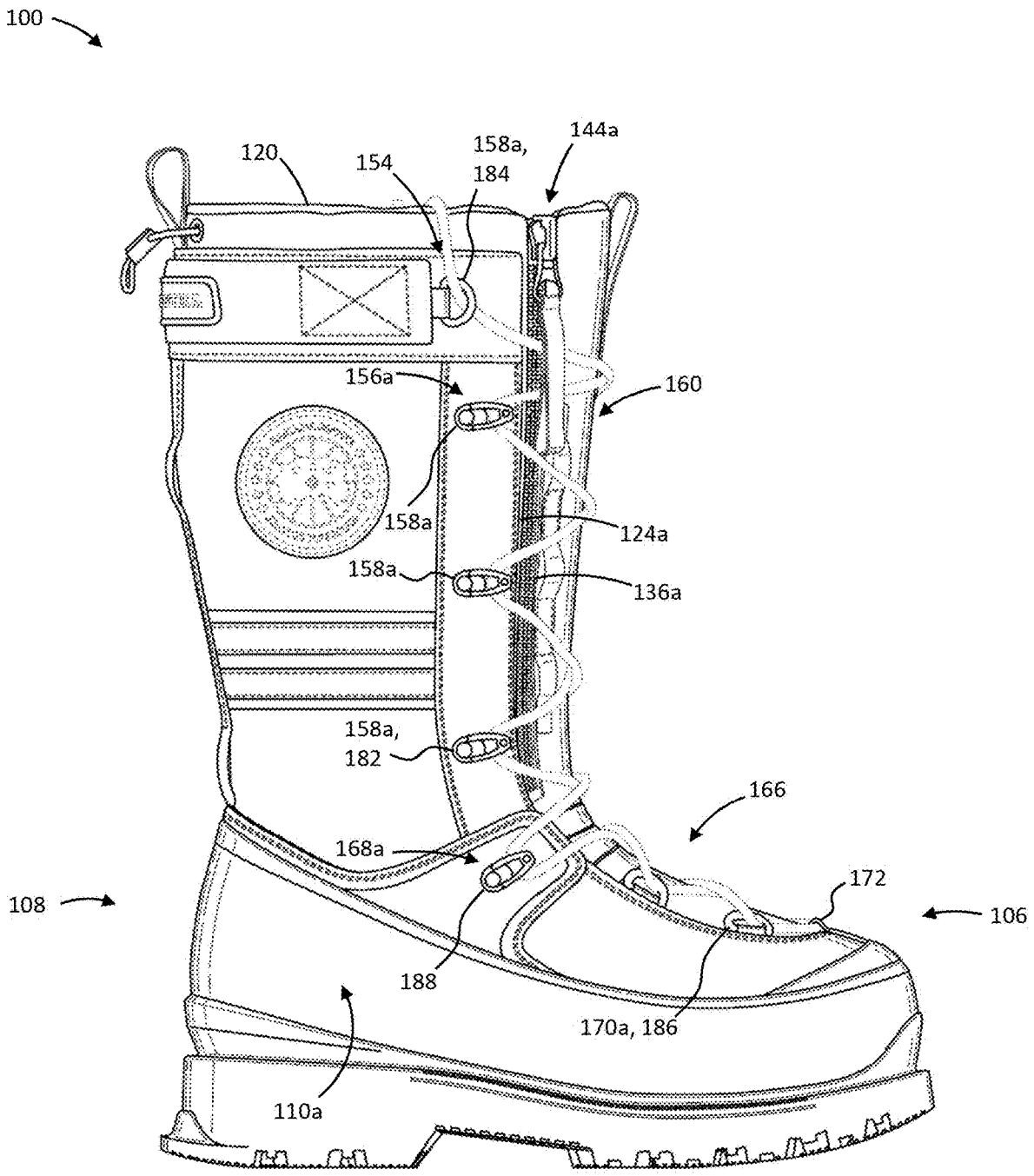
FIG. 5 is a side view of the boot of FIG. 1.

Referring to FIGS. 1 and 5, in the example illustrated, an outboard lacing system 154 is provided on the side portions 110*a*, 110*b* of the upper 104 outboard of the tongue fasteners 144*a*, 144*b*. In the example illustrated, the outboard lacing system 154 includes a pair of outboard rows 156*a*, 156*b* of corresponding outboard lace guides 158*a*, 158*b*. The outboard rows 156*a*, 156*b* are spaced laterally apart from each other, and each outboard row 156*a*, 156*b* is adjacent the front edge 124*a*, 124*b* of a corresponding side portion 110*a*, 110*b*. Each outboard row 156*a*, 156*b* includes a plurality of corresponding outboard lace guides 158*a*, 158*b* spaced apart from each other along the front edge 124*a*, 124*b* of a corresponding side portion 110*a*, 110*b* (see also FIG. 5). In the example illustrated, the pair of outboard rows 156*a*, 156*b* are arranged to guide lacing 159 therebetween (e.g. in a crisscross or other lacing pattern) across the gusseted tongue 128 and tongue fasteners 144*a*, 144*b* when the tongue fasteners 144*a*, 144*b* are in the closed configuration (with the gaps 146*a*, 146*b* closed and the gussets 138*a*, 138*b* collapsed).

Referring to FIG. 2, in the example illustrated, an inboard lacing system 160 is provided on the tongue panel 130 inboard of the tongue fasteners 144*a*, 144*b*. The inboard lacing system 160 includes a pair of inboard rows 162*a*, 162*b* of corresponding inboard lace guides 164*a*, 164*b*. The inboard rows 162*a*, 162*b* are spaced laterally apart from each other, and each inboard row 162*a*, 162*b* is attached to the tongue panel 130 adjacent a corresponding side edge 136*a*, 136*b*. Each inboard row 162*a*, 162*b* includes a plurality of corresponding inboard lace guides 164*a*, 164*b* spaced apart from each other along a corresponding side edge 136*a*, 136*b*. The pair of inboard rows 162*a*, 162*b* are arranged to guide the lacing 159 therebetween (e.g. in a crisscross or other lacing pattern) across the tongue panel 130 inboard and clear of the tongue fasteners 144*a*, 144*b* when the tongue fasteners 144*a*, 144*b* are in the open configuration.

In the example illustrated, a lower lacing system 166 is provided on at least the forefoot portion 106 of the upper 104 below the tongue fasteners 144*a*, 144*b* and the outboard and inboard lacing systems 154, 160. The lower lacing system 166 includes a pair of lower rows 168*a*, 168*b* of corresponding lower lace guides 170*a*, 170*b*. The pair of lower rows 168*a*, 168*b* are spaced laterally apart from each other, and each lower row 168*a*, 168*b* is positioned toward a corresponding side of the upper 104. Each lower row 168*a*, 168*b* includes a plurality of corresponding lower lace guides 170*a*, 170*b* spaced apart from each other along at least the forefoot portion 106. The pair of lower rows 168*a*, 168*b* are arranged to guide a lower portion 159*a* of the lacing 159 across at least the forefoot portion 106 while an upper portion 159*b* of the lacing 159 is guided through either one of the inboard lacing system 160 and the outboard lacing system 154 (e.g. depending on whether the tongue fasteners 144*a*, 144*b* are in the closed configuration for use of the outboard lacing system 154 as shown in FIG. 1, or in the open configuration for use of the inboard lacing system 160 as shown in FIG. 2). In the example illustrated, the lower lacing system 166 further includes a central lace guide 172 forward of and centered between the pair of lower rows 168*a*, 168*b* of lower lace guides 170*a*, 170*b*.

In the example illustrated, each of the outboard, inboard, and lower lacing systems 154, 160, 166 are provided on an exterior of the boot 100. In the example illustrated, each of the outboard, inboard, and lower lace guides 158*a*, 158*b*, 164*a*, 164*b*, 170*a*, 170*b* can comprise, for example, eyelets, hooks, loops, rings, openings, and/or a combination thereof.

Referring to FIG. 3, in the example illustrated, the inboard lace guides 164*a*, 164*b* comprise a plurality of lace-receiving openings 174 spaced apart from each other along a corresponding side edge 136*a*, 136*b* of the tongue panel 130. In the example illustrated, the inboard lacing system 160 comprises a pair of strips 176*a*, 176*b* attached to the tongue panel 130. Each strip 176*a*, 176*b* extends along and adjacent a corresponding side edge 136*a*, 136*b* of the tongue panel 130. Each strip 176*a*, 176*b* has a plurality of attached portions 178 attached to the tongue panel 130 and spaced apart from each other along a corresponding side edge 136*a*, 136*b*, and a plurality of detached portions 180 interspersed between the attached portions 178 and spaced apart from the tongue panel 130 to define the lace-receiving openings 174.

Referring to FIG. 5, in the example illustrated, each outboard row 156*a*, 156*b* of outboard lace guides 158*a*, 158*b* comprises a plurality of eyelets 182 spaced apart from each other along the front edge 124*a*, 124*b* of a corresponding side portion 110*a*, 110*b* (see also FIG. 1). In the example illustrated, each outboard row 156*a*, 156*b* of outboard lace guides 158*a*, 158*b* further comprises at least one upper D-ring 184 above the plurality of eyelets 182 and adjacent the upper periphery 120 (see also FIG. 1).

Figure 4:
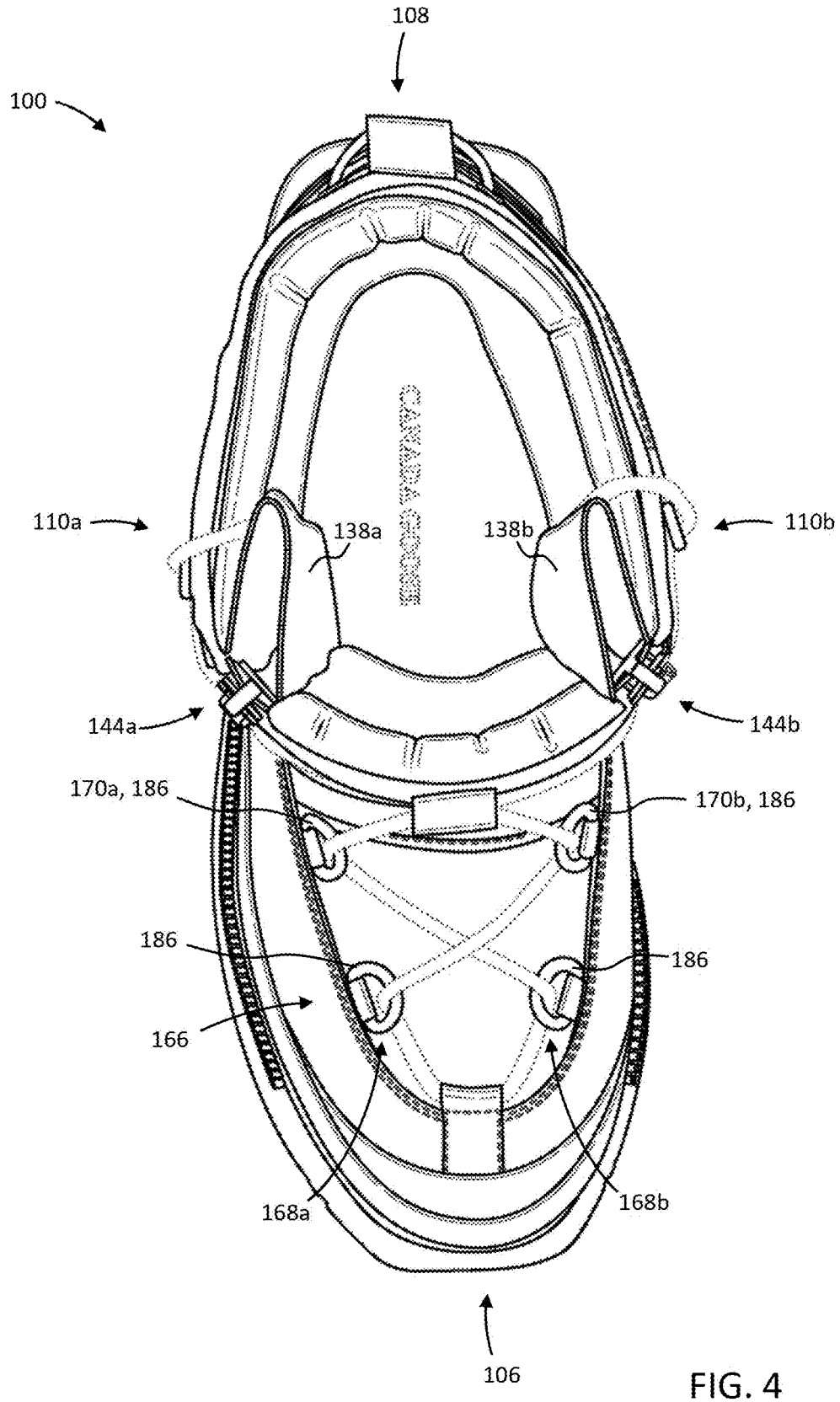
FIG. 4 is a top view of the boot of FIG. 1.

Referring to FIG. 4, in the example illustrated, each lower row 168*a*, 168*b* of lower lace guides 170*a*, 170*b* comprises a plurality of lower D-rings 186 spaced apart from each other along the forefoot portion 106 of the upper 104. Referring to FIG. 5, in the example illustrated, each lower row 168*a*, 168*b* of lower lace guides 170*a*, 170*b* further comprises an eyelet 188. The eyelet 188 of each lower row 168*a*, 168*b* is positioned rearward of the lower D-rings 186 of each lower row 168*a*, 168*b* (and below the outboard and inboard lacing systems 154, 160). In the example illustrated, the central lace guide 172 of the lower lacing system 166 comprises a loop.

The invention claimed is:

1. A footwear article comprising:

a) an upper;

b) at least one gusset in the upper;

c) at least one fastener configured to selectively expand and collapse the gusset for expanding and contracting, respectively, a foot-receiving opening of the footwear article;

d) a first lacing system on the upper and arranged for guiding lacing across the upper over the at least one gusset and the at least one fastener when the at least one gusset is collapsed, the first lacing system being located outboard of the at least one gusset; and e) a second lacing system being located inboard of the first lacing system and the gusset, the second lacing system arranged for guiding the lacing clear of the at least one gusset and the at least one fastener when the at least one gusset is expanded, wherein the lacing is configured to be guided through the first lacing system when the at least one gusset is collapsed; and wherein the lacing is configured to be guided through-the second lacing system when the at least one gusset is expanded.

2. The footwear article of claim 1, wherein the at least one fastener comprises a zipper.

3. The footwear article of claim 1, wherein the first lacing system comprises a pair of first rows of lace guides, and the second lacing system comprises a pair of second rows of lace guides positioned between the pair of first rows.

4. The footwear article of claim 1, further comprising a tongue panel having at least one side edge attached to the upper through the at least one gusset, and wherein the first lacing system is outboard of the tongue panel and the at least one gusset, and the second lacing system is on the tongue panel.

5. The footwear article of claim 1, further comprising: (f) a third lacing system on the upper below the first and second lacing systems, the third lacing system arranged for guiding a lower portion of the lacing across the upper clear of the at least one gusset and the at least one fastener while an upper portion of the lacing is guided through either one of the first lacing system and the second lacing system.

6. The footwear article of claim 1, wherein the second lacing system adjusts a tightness of a shaft section of the upper when the at least one gusset is expanded.

7. The footwear article of claim 1, wherein the second lacing system is further arranged for guiding the lacing clear of and permitting access to and use of the at least one gusset and the at least one fastener when the at least one gusset is expanded.

8. A method of lacing a footwear article comprising:

a) an upper;

b) at least one gusset in the upper;

c) at least one fastener configured to selectively expand and collapse the gusset for expanding and contracting, respectively, a foot-receiving opening of the footwear article;

d) a first lacing system on the upper and arranged for guiding lacing across the upper over the at least one gusset and the at least one fastener when the at least one gusset is collapsed, the first lacing system being located outboard of the at least one gusset; and e) a second lacing system being located inboard of the first lacing system and the gusset, the second lacing system arranged for guiding the lacing clear of the at least one gusset and the at least one fastener when the at least one gusset is expanded, the method comprising (i) guiding the lacing through the first lacing system when the at least one gusset is collapsed or (ii) guiding the lacing through the second lacing system when the at least one gusset is expanded.

* * * * *